United States Patent [19]

Dillmann

[11] 4,092,101

[45] May 30, 1978

[54] PROCESS FOR FIXING PRINTS WITH REACTIVE DYESTUFFS ON TEXTILE MATERIALS OF NATIVE OR REGENERATED CELLULOSE AND MIXTURES THEREOF WITH SYNTHETIC FIBERS

[75] Inventor: Gerhard Dillmann, Kriftel, Taunus, Germany

[73] Assignee: Hoechst Aktiengesellschaft, Frankfurt am Main, Germany

[21] Appl. No.: 757,499

[22] Filed: Jan. 7, 1977

Related U.S. Application Data

[63] Continuation of Ser. No. 560,511, Mar. 20, 1975, abandoned, which is a continuation of Ser. No. 374,117, Jun. 27, 1973, abandoned.

[30] Foreign Application Priority Data

Jun. 29, 1972 Germany ..... 2231691

[51] Int. Cl.[2] ..... D06P 3/10

[52] U.S. Cl. ..... 8/1 E; 8/1 P; 8/18 R; 8/163

[58] Field of Search ..... 8/1 E, 1 P, 17, 18, 8/163

[56] References Cited

U.S. PATENT DOCUMENTS

| | | | |
|---|---|---|---|
| 3,416,876 | 12/1968 | Ohmer | 8/54.2 |
| 3,416,878 | 12/1968 | Biber | 8/54.2 |
| 3,418,308 | 12/1968 | Ischer | 260/154 |

*Primary Examiner*—Paul R. Michl

*Attorney, Agent, or Firm*—Curtis, Morris & Safford

[57] ABSTRACT

Process for fixing prints with reactive dyestuffs on textile materials of native or regenerated fibers and fiber mixtures which contain such fibers in admixture with synthetic fibers, which process comprises printing reactive dyestuffs having the usual printing paste composition on the textile material, drying, impregnating with an alkali mixture of liquid alkali water glass of 37°–52° Be and concentrated sodium hydroxide solution of 38°–50° Be at pH 10–14, preferably 11–12, and fixing. By this process the drawbacks of using either a sodium hydroxide soluion or liquid alkali water glass alone are avoided. The fixing solution is rendered more fluid to such an extent that less liquor is consumed, the heating of the liquor is made superfluous, deposits on the rolls are avoided, the material to be printed is more rapidly wetted, the fabric webs do not dry on or stick together during the dwelling periods and thus the process is rendered more economical in total.

2 Claims, No Drawings

PROCESS FOR FIXING PRINTS WITH REACTIVE DYESTUFFS ON TEXTILE MATERIALS OF NATIVE OR REGENERATED CELLULOSE AND MIXTURES THEREOF WITH SYNTHETIC FIBERS

This application is a continuation of copending application Ser. No. 560,511, filed Mar. 20, 1975, now abandoned, which application was a continuation of copending application Ser. No. 374,117 filed June 27, 1973 now abandoned.

The present invention relates to a process for fixing prints with reactive dyestuffs on textile materials of native or regenerated cellulose and mixtures thereof with synthetic fibers.

German Offenlegungsschrift Nos. 1,469,722 and 1,619,492 have disclosed processes for fixing prints with reactive dyestuffs. According to the methods described therein the dyestuff fixation is carried out in such a manner that the dyestuff is applied in a first stage from a neutral printing paste to the fabric, and, after drying, the fabric is impregnated in a second stage with a relatively strong alkaline solution containing electrolytes and then fixed by the action of heat, for example according to the two-stage steaming process, the wet-fixing process or the cold-dwell process.

The use of alkaline, salt-containing liquors as fixing medium has, however, the drawback, that already small changes in the concentration of electrolytes, the fixing period and the fixing temperature affect the dyestuff yield and the appearance of the prints. Besides, the relatively high alkali concentrations of about 100 ml of sodium hydroxide solution of 38° Be per liter of salt-containing padding liquor causes the shades of a series of dyestuffs to be more or less heavily shifted because of hydrolysis during the fixing period required. These difficulties could completely be overcome by using pure liquid alkali water glass of 48° - 52° Be at a pH of about 11-12 as fixing medium. Those fixing methods are, for example, described in German Offenlegungsschriften Nos. 1,619,503 and 1,619,502. Anhydrous water glass in this range of concentration having a density of from 1.48 to 1.55 and a weight ratio $Na_2O : SiO_2$ of 1:2.1 to 1:3 is, however, a rather high-viscous solution, which can be handled in practice on an industrial scale only with a number of serious drawbacks. For better working conditions, the water glass must be pre-heated to 40°-50° C which makes it more fluid. During the impregnation step, however, cooling occurs when it passes through the air between the trough and the pad and, above all, on the pad rolls themselves to such an extent that tacky deposits are formed which are hardened by crystallisation during a prolonged operation time of the machine, are difficult to be removed and cause big troubles in the operation of the machine. When proceeding according to the cold-dwell method the impregnated material sticks very much together when being unwrapped or rolled up and can, therefore, be worked further only with difficulties. The pad rolls also stick together so rapidly when the machine stands still that the material mostly tears off when the machine starts again.

It was, now, found that these difficulties could be overcome when impregnating prints with reactive dyestuffs with an alkali mixture of liquid alkali water glass of 37°-52° Be and sodium hydroxide solution of 38°-50° Be at pH 10-14 and fixing it in usual manner. When proceeding according to the two-stage-cold-dwell method an alkali mixture of soda water glass of 48°-52° Be having a weight ratio $Na_2O : SiO_2$ of 1:2.6 and sodium hydroxide solution of 48°-50° Be in a mixing ratio of 9.5:0.5 to 9:1 is advantageously used. The weight ratio $Na_2O : SiO_2$ of the final fixing solution is 1:1.9 to 1:2.3.

When using the two-stage wet-fixing method or the two-stage steaming method an alkali mixture of soda water glass of 37°-52° Be having a weight ratio $Na_2O : SiO_2$ of 1:1.85 to 1:2.1 and sodium hydroxide solution of 38°-50° Be in a mixing ratio of 9:1 to 6:4 is used. The weight ratio $Na_2O : SiO_2$ of the final fixing solution is in this case 1:1.33 to 1:1.85. Changes of the concentration of sodium hydroxide solution of ± 10% have no influence on the dyestuff yield because of the high buffer effect of water glass.

Suitable reactive dyestuffs for the fixation on native or regenerated cellulose and the cellulose fiber portion in mixed fabrics may be representatives of the most different organic dyestuff classes, for example, of azo, anthraquinone and phthalocyanine dyestuffs which contain at least one β-hydroxyethyl-sulfon sulfuric acid ester group vinylsulfonyl group, monochlorotriazine group, dichlorotriazine group, 2,2,3,3-tetrafluorocyclobutan-1-acroylamino group, vinylsulfonylamino group, β-hydroxyethyl-sulfonylamino-sulfuric acid ester group, β-phenylsulfonyl-propionylamino group or a dichloroquinoxaline radical, or which can react with a colourless compound which contains at least two reactive groups and can react not only with the fiber but also with the dyestuff containing nucleophilic groups.

Suitable compounds having at least two reactive groups which link the dyestuff carrying nucleophilic groups as bridge member with the fiber are, for example 1,3,5-tri-(acroyl)hexahydro-s-triazine, methylene-bis-acrylamide or 2,4,6-triethylene-imino-s-triazine.

Suitable dyestuffs which react with the fiber through these bifunctional compounds are, preferably, those of the azo and anthraquinone series which contain as nucleophilic groups, for example, sulfonamide, N-monosubstituted sulfonic acid amine, hydroxy, mercapto and/or acetoacetyl groups and/or heterocyclic ring system containing imino groups.

Suitable thickeners for the printing pastes are, for example, alginates of neutral, slightly alkaline or slightly acid reaction, rubber sorts, alkyl cellulose or hydroxyethyl-cellulose, the mixtures thereof and emulsions or semi-emulsions prepared therefrom by means of suitable emulsifiers.

When adding slight amounts of sodium hydroxide solution to the water glass the fixing solution is rendered more fluid to such an extent that less liquor is consumed, the heating of the liquor is made superfluous, deposits on the rolls are avoided, the material to be printed is more rapidly wetted, the fabric webs do not dry on or stick together during the dwelling periods and thus the process is rendered more econimical in total. When using such water glass/sodium hydroxide fixing solutions, considerably less dyestuff is taken from the material during the fixing process and the fixing solution is far less soiled so that a higher degree of whiteness of the ground and more brilliant, more intense and more plastic prints are obtained.

The Color-Index-Numbers indicated with reference to the dyestuffs used in the following Examples are taken from the 2nd edition 1956 and the complementary volume 1963. These Examples illustrate the invention, the parts and percentages being by weight unless stated otherwise.

EXAMPLE 1

Two printing pastes were prepared by dissolving the following dyestuffs with 300 parts of hot water poured over them, introducing them in 500 parts of an aqueous alginate thickening of 4% and adjusting them with water or thickening to 1000 parts:

a. 40 g of the reactive dyestuff obtained by coupling the diazotized 1-aminobenzene-4-β-oxethylsulfone-sulfuric acid ester with 1-(4'-sulfophenyl)-3-carboxy-5-pyrazolone;

b. 25 g of 1-amino-4-[3'-(β-hydroxy-ethylsulfonyl-phenyl)-amino]-anthraquinone-2-sulfonic acid.

These two printing pastes were applied to a mercerized cotton fabric on a rotary printing machine and fixed at room temperature during 5 hours after drying in the hotflue according to the two-stage cold-dwell method by impregnation with a cold mixture of 900 parts of water glass of 48° Be and 100 parts of sodium hydroxide solution of 50° Be and dwelling in cuttled-up or rolled-up state.

Then, the fabric was rinsed at 40° C. Under neutral reaction of the rinsing water, the fabric was treated at 60° C with three parts of a complex forming agent on the basis of a polymer sodium metaphosphate per 1000 parts by volume of water, then it was soaped for about 10 minutes with an aqueous solution of 4% of a synthetic detergent, for example, the sodium salt of the condensation product of oleic acid and N-methyltaurine, then rinsed and dried.

A brilliant two-coloured print in yellow and blue, at overlapping portions in green on a clear white ground was obtained in an excellent colour yield.

EXAMPLE 2

Two printing pastes were prepared according to the method described in Example 1 using the following dyestuffs in commercial form:

a. 30 g of Reactive Red 9, C.I. No. 17 910 b. 20 g of Reactive Blue 5, C.I. No. 61 210

After adding 10 g of meta-nitrobenzenesulfonic acid sodium these two printing pastes were applied to a spun viscose fabric optionally causterized on a roller printing machine. After drying, the printed fabric was impregnated according to the two-stage steaming method with a mixture of 770 parts of water glass of 40° Be and 230 parts of sodium hydroxide solution of 38° Be with a liquor pick-up of about 70% and fixed for about 40 seconds on a spiral-steamer.

After the usual after-treatment (in a manner analogous to that of Example 1) a two-coloured red-blue design with optimal colour yield on a pure white ground was obtained.

EXAMPLE 3

For the printing on polyester fiber/spun viscose blended fabric (67 : 33) a printing paste was prepared using the following dyestuff mixture of disperse and reactive dyestuff:

40 g of the dyestuff mixture consisting of 55 parts of 1,4-diamino-2,3-diphenoxy-anthraquinone and 45 parts of the dyestuff obtained by coupling the diazotized 1-aminobenzene-4-β-oxethylsulfon-sulfuric acid ester with acetyl-H-acid and converting it into the copper complex were at first pasted with 100 g of cold water and then dispersed in 250 g of hot water.

This dispersion was then introduced with stirring in 350 g of a 4% aqueous alginate thickening and 200 g of a 10% aqueous solution of the esterification product of polyethylene glycol having the molecular weight 2000 with stearic acid and 6 g of a 33% aqueous solution of tartaric acid was added and the mixture was made up to 1 kg with water or thickening.

This printing paste was applied to the polyester fiber/spun viscose blended fabric on a flat printing machine, steamed after drying to fix the portion of disperse dyestuff at first for 15 minutes at 1.5 atmg and then padded to fix the portions of reactive dyestuff according to the two-stage steaming method in a manner analogous to that described in Example 2 with the mixture of water glass and sodium hydroxide solution described therein and steamed.

After the after-treatment carried out in a manner analogous to that described in Example 1 and using in the hot after-treatment baths as auxiliaries 1 – 2 g/l of butandiol-1,4-pentadecaglycoletherdioleylester or 1 – 2 g/l of the condensation product of castor oil with 32 mols of ethylene oxide, a brilliant, reddish violet in an unobjectionable tone-in-tone shade on a pure white ground in a high yield was obtained.

EXAMPLE 4

50 Parts of the dyestuff of the formula

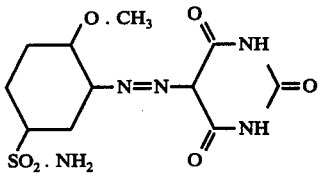

were mixed with 50 parts of urea and 25 parts of the bifunctional cross-linking agent 1,3,5-tri-(acryloyl)-hexahydro-s-triazine, dissolved in 250 parts of hot water, then introduced with stirring into 500 parts of alginate thickening and made up to 1000 parts with 125 parts of water or thickening.

With that printing paste a mercerized cotton fabric was printed with a film printing screen. After drying the fabric was impregnated with a mixture of 950 parts of water glass of 52° Be. and 50 parts of sodium hydroxide solution of 45° Be with a liquor pick-up of about 65% in cold state and stored at room temperature for about 3 hours in cuttled-up or rolled-up state.

After the after-treatment carried out in a manner analogous to that described in Example 1 a clear design in greenish yellow having an excellent fastness to light and to wet processing was obtained in a high colour yield.

EXAMPLE 5

For printing a polyester fiber/cotton blended fabric (50 : 50) 3 printing pastes were prepared as described in Example 3 using the following dyestuff mixtures of disperse and reactive dyestuffs in commercial form (a)

60 g of a dyestuff mixture of 66.7 parts of Disperse Yellow 5, C,I. No. 12 790 and
33.3 parts of the reactive dyestuff obtained by coupling the diazotized 6-chloro-3-amino-4-sulfobenzoic acid with the sulfuric acid ester of the 1-(4'-β-oxethyl-sulfonyl)-phenyl-3-methyl-5-pyrazolone.

(b)

50 g of a dyestuff mixture of
55 parts of 1-amino-4-oxy-2-[4'-(γ-ethoxy-propyl-amino-sulfonyl) phenoxy]-anthraquinone and
45 parts of the reactive dyestuff obtained by coupling the diazotized 2-aminoanisol-4-β-oxethylsulfone-sulfuric acid ester with acetyl-H-acid.

(c)

35 g of the dyestuff mixture of
50 parts of 1,5-diamino-4,8-dioxy-2-anisolanthraquinone and
50 parts of 1-amino-4-[3'-(β-hydroxy-ethylsulfonyl-phenyl)- amino]-anthraquinonoe-2-sulfonic acid.

These 3 printing pastes were applied to the blended fabric on a rotary printing machine.

After drying the dyestuff was fixed by thermofixation at 200° C for 40 seconds on a stenter frame and treatment according to the two-stage-wet-fixing method at 96° C for 6 seconds in an alkali bath consisting of 800 parts of water glass of 40° Be and 200 parts of sodium hydroxide solution of 38° Be.

After the usual after-treatment (described in Example 3) a three-coloured design (yellow, red, blue) in excellent tone-in-tone shade on a pure white ground and in optimal colour yield was obtained.

EXAMPLE 6

3 printing pastes were prepared by dissolving the following dyestuffs in commercial form by pouring over them 250 g of boiling water and introducing them with stirring into 500 g of a 10% aqueous thickening of an ether of locust bean flour:

(a)

60 g of the dyestuff obtained by coupling the diazotized 6-chloro-3-amino-4-sulfobenzoic acid with the sulfuric acid ester of the 1-(4'-β-oxethylsulfonyl)-phenyl-3-methyl-5-pyrazolone.

(b)

50 g of the dyestuff obtained by coupling the diazotized 1-aminobenzene-3-β-oxethylsulfon-sulfuric acid ester with azetyl-γ-acid.

(c)

35 g of 1-amino-4-[3'-β-hydroxy-ethylsulfonylbenzoyl-amino]-anthraquinone-2-sulfonic acid.

These 3 printing pastes were successively applied by film printing to a mercerized cotton fabric and dried in the drying cabinet. The dyestuffs were then fixed according to the two-stage wet-fixing method by passing them during 6 seconds through an alkali solution heated to 95° C consisting of 700 parts of water glass of 40° Be and 100 parts of sodium hydroxide solution of 50° Be and 200 parts of water. After the usual after-treatment (as described in Example 1) a brilliant three-coloured design (yellow, orange, blue) on a pure white ground and in optimal colour yield was obtained.

EXAMPLE 7

To fix prints on polyester fiber/cotton blended fabric (67:33) 2 printing pastes were prepared using the following dyestuff mixtures of disperse dye and reactive dyes in commercial form in an analogous manner to that described in Example 3:

(a)

60 g of the dyestuff mixture of
95 parts of the disperse dyestuff having the following constitution:

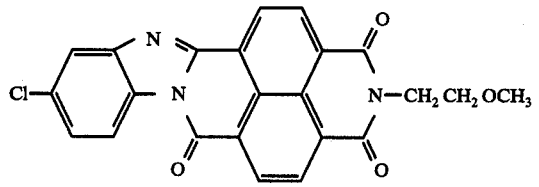

41 parts of the reactive dyestuff obtained by coupling the diazotized sulfuric acid ester of 3-(4'-aminobenzeneamino)-phenyl- β - oxyethylsulfone with 1-(4'-sulfophenyl)-5-pyrazolone-3-carboxylic acid.

(b)

50 g of the dyestuff mixture of
28.6 parts of 1-amino-4-oxy-(6'-oxy-n-hexyl-oxy)-anthraquinone,
28.6 parts of the dyestuff having the following constitution:

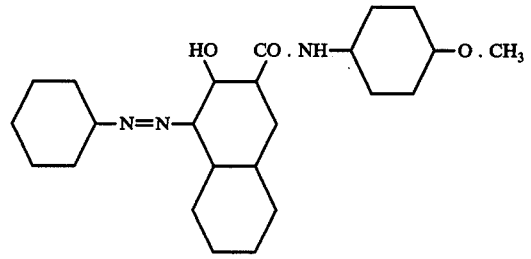

34.3 parts of the dyestuff obtained by coupling the diazotized 1-aminobenzene-4-β-oxyethylsulfon-sulfuric acid ester with azetyl-H-acid and
8.5 parts of the dyestuff obtained by coupling the diazotized 2-aminoanisol-4-β-oxyethylsulfon-sulfuric acid ester with azetyl-H-acid.

These two printing pastes were printed on the blended fabric on a roller printing machine, then dried and thereafter steamed during about 15 minutes at 1.5 atmg. To fix the proportionate reactive dyestuff the material was padded according to the two-stage cold-dwell method with a cold alkali solution having the following composition (squeezing effect: about 65%): 900 parts of water-glass of 52° Be, 100 parts of sodium hydroxide solution of 45° Be. It was then stored in cuttled-up or rolled-up state at room temperature for 3 hours.

After the usual after-treatment (as described in Example 3) a clear, two-coloured print (yellow, orange) with a good tone-in-tone shade on a pure white ground and with an optimal colour yield was obtained.

What I claim is:

1. A process for fixing prints with reactive dyestuffs on textile materials of native or regenerated cellulose fibers and fiber mixtures which contain such fibers in admixture with synthetic fibers, which process comprises applying on the textile material a neutral printing composition containing a reactive dyestuff, drying the printed material, and thereafter fixing said prints according to the two -stage cold-dwell method by impregnating said material with an alkali mixture of liquid soda water glass of 48°–52° Be in a weight ratio of $Na_2O$ : $SiO_2$ of 1 : 2.6 and sodium hydroxide solution of 48°–50° Be, the weight ratio $Na_2O$ : $SiO_2$ of the final fixing solution being 1 : 1.9 to 1 : 2.3.

2. The process for fixing prints with reactive dyestuffs on textile materials of native or regenerated cellulose fibers and fiber mixtures which contain such fibers in admixture with synthetic fibers, which process comprises applying on the textile material a neutral printing composition containing a reactive dyestuff, drying the printed material, and thereafter fixing said prints according to the two-stage wet fixing method or the two-stage steaming method by impregnating said material with an alkali mixture of liquid soda water glass of 37°–52° Be having a weight ratio $Na_2O$ : $SiO_2$ of 1:1.85 to 1:2.1 and sodium hydroxide solution of 38°–50° Be, the weight ratio $Na_2O$ : $SiO_2$ of the final fixing solution being 1:1.33 to 1:1.85.

* * * * *